US009768529B2

(12) United States Patent
Starke

(10) Patent No.: US 9,768,529 B2
(45) Date of Patent: Sep. 19, 2017

(54) CABLE CONNECTION COMPONENT

(71) Applicant: PHOENIX CONTACT GMBH & CO. KG, Blomberg (DE)

(72) Inventor: Cord Starke, Blomberg (DE)

(73) Assignee: Phoenix Contact GmbH & Co., KG, Blomberg (DE)

( * ) Notice: Subject to any disclaimer, the term of this patent is extended or adjusted under 35 U.S.C. 154(b) by 0 days.

(21) Appl. No.: 15/322,235

(22) PCT Filed: Jun. 25, 2015

(86) PCT No.: PCT/EP2015/064424
§ 371 (c)(1),
(2) Date: Dec. 27, 2016

(87) PCT Pub. No.: WO2015/197776
PCT Pub. Date: Dec. 30, 2015

(65) Prior Publication Data

US 2017/0170577 A1 Jun. 15, 2017

(30) Foreign Application Priority Data

Jun. 27, 2014 (DE) ..... 10 2014 109 043

(51) Int. Cl.
*H01R 4/24* (2006.01)
*H01R 13/512* (2006.01)
(Continued)

(52) U.S. Cl.
CPC ..... *H01R 4/2433* (2013.01); *H01R 13/512* (2013.01); *H01R 13/5825* (2013.01); *H01R 13/59* (2013.01)

(58) Field of Classification Search
CPC .... H01R 4/2433; H01R 13/512; H01R 13/59; H01R 13/622; H01R 13/623; H01R 13/625
(Continued)

(56) References Cited

U.S. PATENT DOCUMENTS 6,403,884 B1 * 6/2002 Lange ..... H01R 13/59 174/653
7,850,472 B2 * 12/2010 Friedrich ..... H01R 13/506 439/256
(Continued)

FOREIGN PATENT DOCUMENTS

DE 198 36 622 A1 3/2000

OTHER PUBLICATIONS

Connection Technology for Field Devices and Field Cabling, Phoenix Contact GMBH & Co. KG, 2011 Pluscon, PDF Version, Feb. 2012, pp. 92 and 93.

*Primary Examiner* — Harshad Patel
(74) *Attorney, Agent, or Firm* — David S. Safran

(57) ABSTRACT

A cable connection component for electrically connecting a multi-core cable has a union nut with an internal thread, and a splicing part made of insulating material having a plurality of incisions for separating the cores of the cable. Upon screwing the union nut onto a connection body, the core insulation of the core ends inserted into the splice part are severed by insulation displacement terminations that are arranged in the connection body and are immerge into the incisions in the splice part, and the conductors of the cores are contacted. The splice part has a cable receiving part and a core guiding part, the core guiding part having at least two core receptacles, and each core receptacle having at least two retaining elements and at least two clamp elements forming a clamping gap. The retaining elements and the
(Continued)

clamp elements do not overlap in the core insertion direction.

10 Claims, 5 Drawing Sheets

(51) Int. Cl.
*H01R 13/58* (2006.01)
*H01R 13/59* (2006.01)

(58) Field of Classification Search
USPC ..... 439/253, 411–413, 469, 431, 583–585, 439/664, 690
See application file for complete search history.

(56) References Cited

U.S. PATENT DOCUMENTS

| | | | | |
|---|---|---|---|---|
| 7,938,674 | B2 * | 5/2011 | Lindkamp | H01R 13/5812 439/461 |
| 8,398,419 | B2 * | 3/2013 | Coyle, Jr. | H01R 13/5219 439/275 |
| 9,172,179 | B2 | 10/2015 | Starke et al. | |
| 9,312,629 | B2 * | 4/2016 | Smith | H01R 13/625 |
| 9,490,582 | B2 | 11/2016 | Jaschke et al. | |
| 2010/0248516 | A1 * | 9/2010 | Hui | H01R 13/52 439/271 |
| 2013/0072050 | A1 * | 3/2013 | Andresen | H01R 4/2433 439/389 |

* cited by examiner

CABLE CONNECTION COMPONENT

BACKGROUND OF THE INVENTION

Field of the Invention

The invention relates to a cable connection component for electrically connecting a multi-core cable, comprising a union nut having an internal thread and a splicing part made of insulating material having a number of incisions for separating the cores of the cable. When the union nut is screwed onto a connection body having an external thread corresponding to the internal thread, the core insulation of the core ends inserted into the splice part are severed by insulation displacement terminations that are arranged in the connection body and that extend into the incisions in the splice part, and the conductors of the cores are contacted.

Description of Related Art

A cable connection component as part of a cable connection device is known from both German Patent DE 199 51 455 C1 and corresponding U.S. Pat. No. 6,403,884 B1 as well as German Patent Application DE 10 2011 108 123 A1 and corresponding U.S. Pat. No. 9,172,179 B2. With these cable connection components, the cores of a multi-core cable can be connected in a simple manner to the connecting elements of a device connection component or a cable link component without requiring that the core insulation of the individual cores be removed ahead of time. In the cable connection component depicted, for example, in FIG. 6 of German Patent DE 199 51 455 C1 and corresponding U.S. Pat. No. 6,403,884 B1 and FIG. 1 of German Patent Application DE 10 2011 108 123 A1 and corresponding U.S. Pat. No. 9,172,179 B2, the individual cores of the cable are initially inserted into the splice part which is designated there as a core-holding and -guiding part. The core ends are then crimped and inserted into recesses in the splice part that serve as retaining locks for the cores during radial redirection. Subsequently, the core ends protruding through the recesses are cut off, so that the union nut can then be screwed onto the corresponding external thread of a connecting body. When the union nut is screwed onto the connecting body, the splice part is pressed into the connecting body, whereby the insulation displacement terminations arranged in the connecting body enter into the notches provided in the splice part and thereby penetrate the core insulation of the individual cores (which cross the notches) and contact the individual conductors.

Cable connection or link devices constructed in such a manner (which are already fundamentally known from German Patent DE 198 36 622 C2) have proven to be exceptionally successful in practice for over fifteen years and are especially extensively distributed by the applicant under the product name QUICKON® in various embodiments (cf. pages 92 and 93 of the catalogue "PLUSCON 2011" from Phoenix Contact GmbH & Co. KG).

The transmission of information and data, especially necessary for the use of devices of industrial process- and measurement engineering, is often accomplished by employing multi-core cables. The one end of the cable is frequently thereby connected via a plug connector or a cable connection device to an electrical device (a sensor/actuator box, for example); the other end is connected to the supply connection via, for example, a terminal. During preparation of the connection of the cores of a cable with a cable connection device or plug connector, simple manageability in addition to simple and thereby economic producibility is of particular importance. An exact and reliable positioning of the cores must be ensured—especially with cables having multiple cores with a small cross section—so that the conductors of the cores can be contacted with the insulation displacement terminations without damage.

SUMMARY OF THE INVENTION

The object of the invention is therefore to provide a cable connection component that ensures an uncomplicated and safe contacting—even of multi-core cables—whereby simple production of the cable connection component should simultaneously be possible.

The aforementioned object is accomplished by the cable connection component described at the outset in which the splice part has a cable-receiving part and a core-guiding part as described herein. The splice part is thus composed of two parts, wherein the cable-receiving part essentially conduces the mounting and conducting of the cable itself and the core-guiding part essentially conduces the arrangement and stationary positioning of the individual cores—namely the core ends. Preferably, the cable-receiving part and the core-guiding part are designed in such a manner that they—at least partially—can be inserted into one another in an interlocking manner.

At least two core receptacles are provided on the core-guiding part that conduce the positioning and fixing of the cores before and during the electric contacting by means of the insulation displacement terminations. Preferably, a number of core receptacles on the core-guiding part are provided corresponding to the number of cores of the cable to be connected—for example three, four, five, or eight core receptacles. Each core receptacle has at least two retaining elements and at least two clamp elements which form a clamping gap. The clamp elements are aligned with respect to each other in such a manner that an insulated core can be clamped in the clamping gap.

A guide gap is provided between the retaining elements, through which the core is inserted in the direction of the clamp elements. The function of the retaining elements is to ensure that a core may be inserted in the direction of the clamp elements but cannot readily be removed again or pivot back on its own. To this end, the retaining elements preferably each have a lead-in chamfer tilted in the direction of the guide gap. The retaining elements especially preferably have, on their sides facing the direction of the clamp elements, a protruding catch area which prevents or at least impedes removal of the core, especially inadvertent removal.

In the core receptacles, the retaining elements are arranged first, followed by the clamp elements, with respect to the direction of core insertion. The core-insertion direction runs parallel to the longitudinal axis of the core-guiding part and is the direction in which the cores of a cable are inserted into the core receptacle for fixture in such a core receptacle. Any and all cores are thereto initially fed—opposite to the direction of core-insertion—through a central opening in the core-guiding part and each crimped by roughly 90° in the direction of the respective core receptacle and finally inserted into the core receptacle—that is, initially through the retaining elements and then into the clamp gap of the clamp elements.

Preferably, bridges are arranged between the core receptacles which extend in the longitudinal direction of the core-guiding part and on which the clamp elements and the retaining elements of a core receptacle are fixed or formed. As a consequence, the incisions provided for the cutter are also arranged between the bridges.

Structurally, the distances between the inner surfaces and the outer surfaces of the clamp elements and the retaining elements, on the one hand, and the longitudinal axis of the core-guiding part on the other are selected such that there is no overlapping of the retaining elements or the clamp elements in the core insertion direction so that the clamp elements and the retaining elements are arranged so as not to overlap. The term "inner surfaces" always denotes the surfaces that are oriented towards the longitudinal axis of the core-guiding part—that is, oriented "inwardly"—while "outer surfaces" denotes the surfaces that are oriented away from the longitudinal axis—that is, oriented "outwardly."

The inner surfaces and the outer surfaces of the retaining elements and the clamp elements are, in their extension, preferably arranged parallel to the longitudinal axis of the core-guiding part; that is, not tilted in the direction of the longitudinal axis/in the longitudinal direction. The distance from the longitudinal axis is, in the case of an even surface, the distance between the plane normal of this surface and the longitudinal axis. In the case of a curved surface which is arranged on a radius about the longitudinal axis of the core-guiding part, the distance corresponds to the radius. Preferably, the inner surfaces and the outer surfaces (which are aligned with each other) are thereby arranged parallel to one another, offset in the longitudinal direction.

The attribute "non-overlapping" in this context means that when observing the core-guiding part longitudinally—in the core insertion direction—there is no overlapping of the retaining elements and the clamp elements. The form and arrangement of the retaining elements and the clamp elements are selected to ensure that no overlapping exists in the longitudinal direction of the core-guiding part. The retaining elements and the clamp elements are thus aligned offset to one another.

The offset arrangement of the clamp elements and the retaining elements is advantageous in that an unintentional release of the cores after introduction into the core receptacles can be more reliably prevented than in configurations known from the state of the art. This is especially ensured in that the stretch over which a core is at least partially surrounded by the retaining elements or by the clamp elements is extended radially. The length of the stretch then namely corresponds to at least the thickness of the retaining elements plus at least the thickness of the clamp elements. The risk of a "tilting out" of a core after introduction into a core receptacle is thereby reduced.

It is noted that such an arrangement of the clamp elements and the retaining elements makes possible an especially simple assembly of the core-guiding part. The non-overlapping arrangement of the clamp elements and the retaining elements means that manufacture of the core-guiding part can take place in a simple manner with two forming pins, movable in the longitudinal direction of the core-guiding part. From these forming pins, unmolding of the core-guiding part also takes place longitudinally. The use of longitudinally movable forming pins makes it simple to manufacture cable connection components with a series of core receptacles, whereby the positions of the core receptacles and therewith also the positions of the insulation displacement contacts on the core-guiding part can be discretionarily selected. The positioning of the core receptacles can thus be optimized especially in regard to the high-frequency characteristics of the cable connection component.

According to a first advantageous configuration of the cable connection component, it is provided that the distance between the outer surfaces of the clamp elements and the longitudinal axis of the core-guiding part is less than or equal to the distance between the inner surfaces of the retaining elements and the longitudinal axis. Even in a configuration in which the distance between the outer surfaces of the clamp elements is equal to the distance between the inner surfaces of the retaining elements, the clamp elements and the retaining elements do not overlap; rather, upon inspection, they lock exactly flush with one another in the core insertion direction. Each retaining element is thereby assigned a clamping element in the core insertion direction, so that the outer surface of one clamp element runs parallel to the inner surface of the matching retaining element. Preferably, the inner surfaces and the outer surfaces are even surfaces.

When choosing the distances between the inner surfaces and the outer surfaces and the longitudinal axis of the core-guiding part according to this configuration, the retaining elements and the clamp elements are thus arranged in a step-like manner in the core insertion direction, wherein the retaining elements form an outer step and the clamp elements form an inner step. The clamp elements are thus, with regard to the retaining elements, shifted inwardly in the direction of the longitudinal axis of the core-guiding part.

Another preferred configuration of the cable connection component provides for the core receptacles in the core insertion direction following the clamp elements to each have a contact area and for the distance between the outer surfaces of the contact area and the longitudinal axis to be less than or equal to the distance between the inner surfaces of the clamp elements and the longitudinal axis. The contact area is thus arranged in the core insertion direction behind the clamp elements on the core-guiding part. The contact area preferably comprises two surface elements, wherein each surface element is assigned to one clamp element. In particular, the outer surfaces of the contact area, namely the respective surface elements, are arranged parallel and offset to the inner surface (which is preceding in the core insertion direction) of the clamp element.

Altogether with the contact area, a step-like arrangement emerges, in which the inner surfaces of the retaining elements are, upon observation, arranged in the core insertion direction congruently with the outer surfaces of the clamp elements, and the inner surfaces of the clamp elements are arranged congruently with the outer surfaces of the contact area.

According to a further configuration, reliable core-guiding is especially ensured in that the retaining elements and the clamp elements and/or the clamp elements and the contact area are separated from one another in the longitudinal direction of the core-guiding part. Between the retaining elements and/or the clamp elements or between the clamp elements and the contact area, a gap is preferably provided for this purpose. Advantageously, the gap has a length between approximately 0.5 mm and 5 mm. Due to the separated arrangement, the clamp elements are completely free.

According to a further configuration, it is especially advantageous when it is additionally provided that the inner surfaces of two clamp elements of two neighboring core receptacles lie in a shared plane and that this plane is arranged parallel to the longitudinal axis of the core-guiding part. The inner surfaces of the two—immediately adjacent—clamp elements of two adjacent core receptacles lie thereby in a plane that is tangentially arranged on an imaginary circle about the longitudinal axis of the core-guiding part. Such an arrangement of the clamp elements makes possible a simple arrangement of the core receptacles. Both of the clamp elements of a core receptacle are then arranged opposite one another at an angle that corresponds to the angle between the two planes arranged tangentially on the imaginary circle.

In this embodiment, it is especially preferred for the outer surfaces of two clamp elements and the inner surfaces of two retaining elements of two adjacent core receptacles to be arranged in a common plane as well. Arranging the outer surfaces and the inner surfaces in a common plane ensures that a non-overlapping arrangement of the clamp elements and the retaining elements in the core insertion direction exists.

According to a further configuration, the arrangement of the core receptacles on the core-guiding part may also be simplified by arranging the inner surfaces of the retaining elements on a common first radius. The inner surfaces of all retaining elements are thus curved and have an identical radial distance between them and the longitudinal axis of the core-guiding part. This distance corresponds to a first radius. It is additionally or alternatively provided that the inner surfaces of the clamp elements are likewise arranged on a common second radius about the longitudinal axis of the core-guiding part. The inner surfaces of the clamp elements also thus have a curved form oriented at least in the direction of the longitudinal axis of the core-guiding part. Especially preferably, the outer surfaces of the retaining elements are also curved and arranged on a common radius about the longitudinal axis.

In the aforementioned configuration, it has proven to be advantageous to arrange the inner surfaces of the retaining elements and the outer surfaces of the clamp elements on a common first radius. Doing so ensures that a non-overlapping arrangement of the retaining elements and the clamp elements in the core insertion direction is produced. Arranging the inner surfaces of the retaining elements and the outer surfaces of the clamp elements on a common first radius creates a step-shaped, offset arrangement of the clamp elements and the retaining elements.

To optimize the high-frequency characteristics of a plug connector when using a cable connection component according to the invention, it is advantageous for the core receptacles to be asymmetrically arranged on the core-guiding part, especially arranged asymmetrically distributed on the circumference of the core-guiding part. An asymmetrical arrangement of the core receptacles on the core-guiding part makes it possible to group the cores of a cable, so that, for example, the core receptacles for cores which should carry influencing signals are arranged further away from one another. In the case of a five-core cable, for example, a grouping of the core receptacles into a first group with two core receptacles and a second group with three core receptacles is provided, wherein larger distances are provided between the core receptacles of the two groups than between the core receptacles of one group. In the case of a core-guiding part with an essentially circular basic form, it is appropriate to arrange the core receptacles on the front end of the core-guiding part and asymmetrically about the circumference of the core-guiding part.

According to a last configuration described here, assembly of the cable connection component may be simplified in that the cable-receiving part has multiple latching arms on the side facing the core-guiding part and that the core-guiding part has, on the side facing the cable-receiving part, multiple inwardly projecting latching catches or catch recesses corresponding to the latching arms, so that the core-guiding part is able to latch with the cable-receiving part. The splice part of the cable connection component can thus be manufactured in a simple manner in that the two components—the core-guiding part and the cable-receiving part—are latched together.

In particular, there are now a number of possible ways to configure and further develop the cable connection component according to the invention. In this respect, reference is made to the following description of a preferred embodiment example in connection with the accompanying drawings.

DETAILED DESCRIPTION OF THE INVENTION

Figure 1:
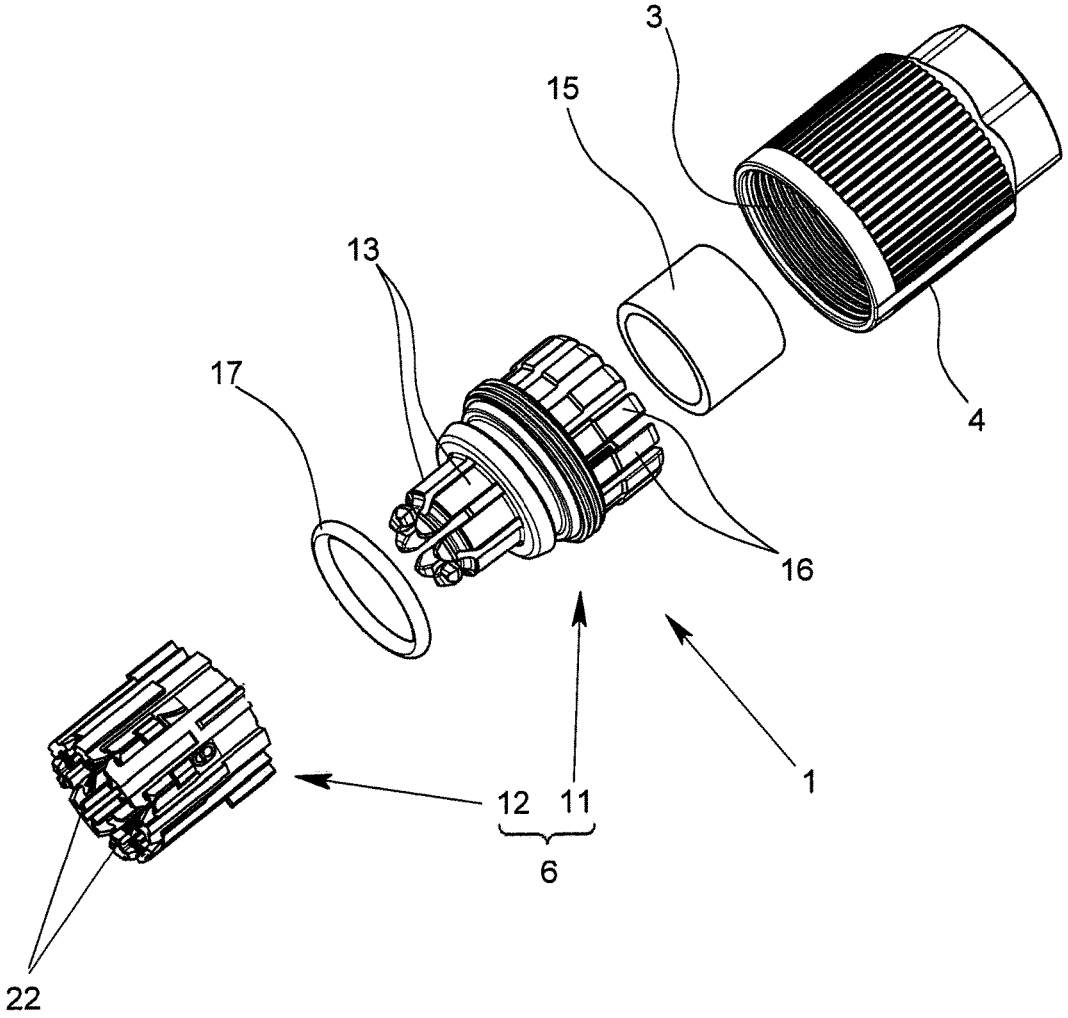
FIG. 1 shows an exploded perspective view of a cable connection component.
Figure 2:
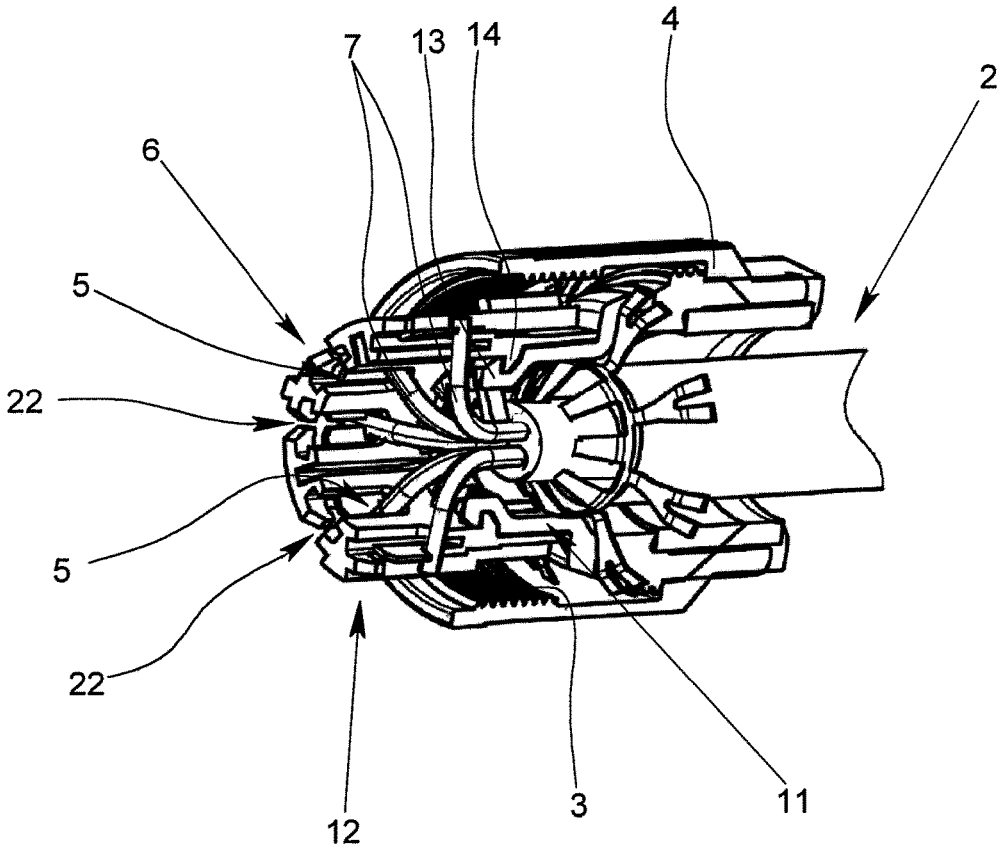
FIG. 2 is a partially sectioned perspective view of a cable connection component with an attached cable.
Figure 3:
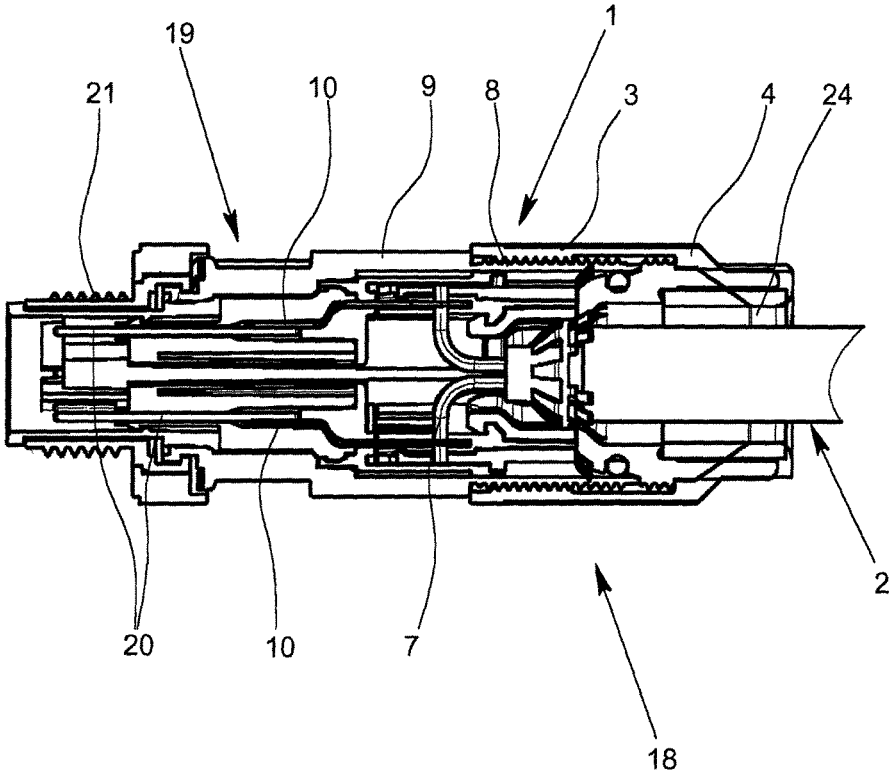
FIG. 3 is a longitudinal sectional view of a cable connection device with a cable connection component having an attached cable.

FIG. 1 shows a cable connection component 1 according to the invention for connecting a multi-core cable 2, depicted in FIGS. 2 and 3. The cable connection component 1 especially has a union nut 4 which has an internal thread 3 and a splice part 6 which has a series of incisions 5 and is composed of insulating material. The number of the incisions 5 thereby corresponds to at least the number of cores 7 of the cable 2. If the union nut 4, with its internal thread 3, is screwed onto a connection body 9 which has a corresponding external thread 8, the splice part 6 is pressed into the cylindrical connection body 9, whereby the insulation displacement terminations 10 arranged in the connection body 9 penetrate into the incisions 5 in the splice part 6, penetrate the core insulation of the individual cores 7 (which, when mounted, cross the incisions 5), and contact the individual cores 7.

As the exploded diagram according to FIG. 1 shows, the splice part 6 comprises a cable-receiving part 11 and a sleeve-like core-guiding part 12 which latches with the cable-receiving part 11. The cable-receiving part 11 thereby has a series of flexible latching arms 13, and the core-guiding part 12 has inwardly-pointing—that is, in the direction of the longitudinal axis of the core-guiding part 12—latching catches 14 which correspond to the latching arms 13. To assemble the splice part 6, the core-guiding part 12, with its sleeve-shaped area, is attached to the cable-receiving part 11, wherein the latching catches 14 latch with the latching arms 13 (cf. FIG. 2).

As FIG. 1 further shows, the cable connection component 1 has an annular seal 15 which, together with a series of annular lamellae 16 formed on the cable-receiving part 11, forms a strain-relief- and sealing area. When the union nut 4 is screwed on, the lamellae 16 work together with a bevel in the form of an armored-thread gland provided inside the union nut 4, so that, when the union nut 4 is screwed onto the connecting body 9, the lamellae 16 are pressed against the seal 15. This simultaneously creates a sealing of and strain-relief for an inserted cable 2. Additionally, an O-ring seal 17 is provided between the cable-receiving part 11 and the core-guiding part 12. During assembly, seal 17 is inserted into a nut designated for this purpose on the cable-receiving part 11.

A cable connection device 18 as depicted in FIG. 3 comprises a cable connection component 1 and a device connection component 19. The device connection component 19 has a connecting body 9 with an external thread 8, a number of insulation displacement terminations 10 corresponding to the number of cores 7 to be connected, and connecting elements 20 electrically conductively connected to the insulation displacement terminations 10. In the present case, the connecting elements 20 are formed as male contacts which are each soldered or welded to the insulation displacement terminations 10. In the embodiment example of the cable connection device 18 depicted in FIG. 3, the device connection component 19 is formed as a connector. The connecting body 9 has, on the side facing away from the cable connection component 1, a second external thread 21 which pivots and can thus be screwed into a corresponding socket on a device.

To electrically conductively connect a multi-core cable 2, the cable 2 is first inserted into the cable connection component 1 by inserting the end of the cable 2 through the rear opening in the union nut 4 far enough into the splice part 6 that the individual core ends on the front side facing away from the union nut 4 protrude out of the splice part 6 or the core-guiding part 12. Next, the individual core ends are turned outwardly about 90° and inserted into the core receptacles 22 formed in the core-guiding part 12 (cf. FIG. 2).

Figure 4:
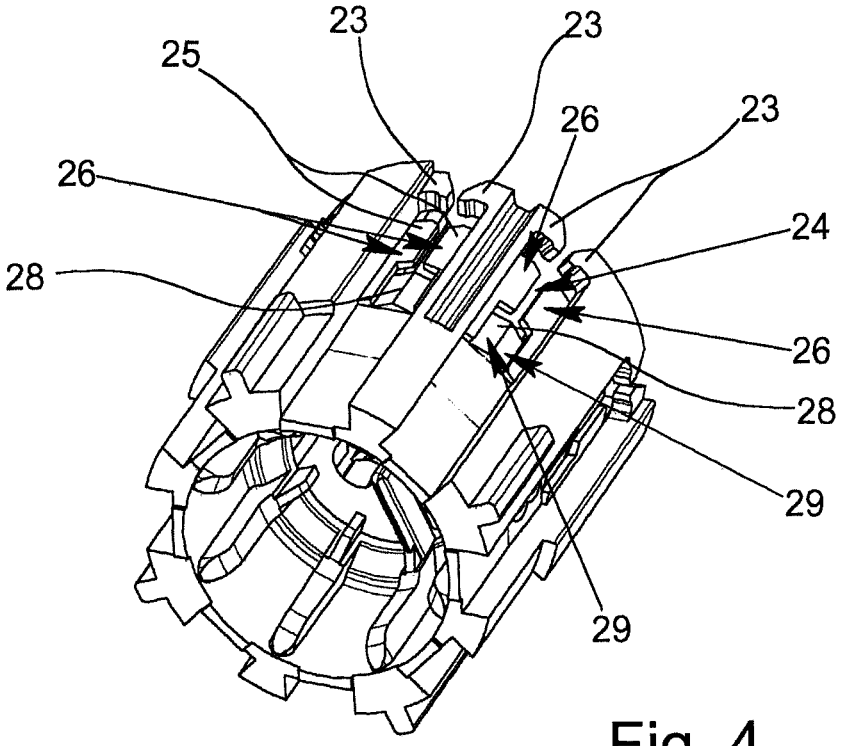
FIG. 4 is a perspective view of a separate core-guiding part.
Figure 5:
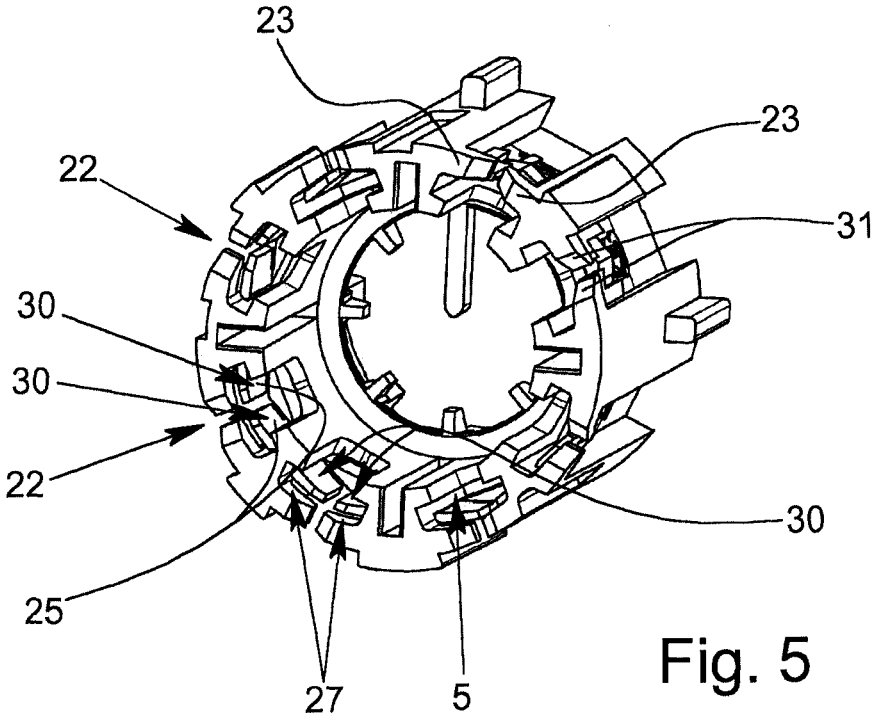
FIG. 5 is a second perspective view of the core-guiding part shown in FIG. 4.
Figure 6:
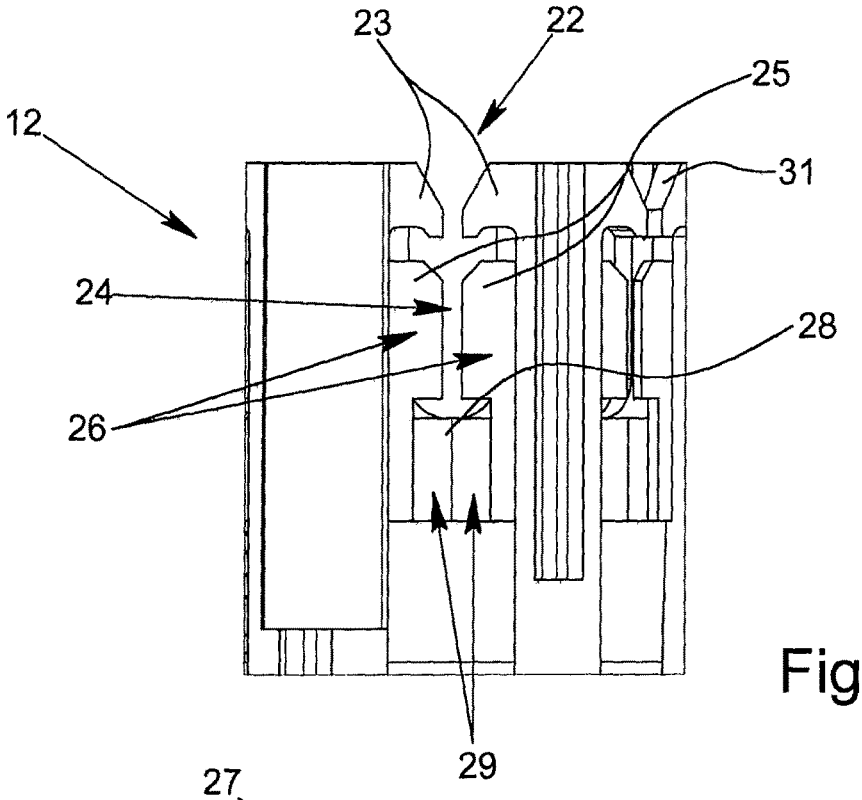
FIG. 6 shows part of a core-guiding part.

The construction of the core receptacles 22 is especially readily visible in FIGS. 4 to 6. Each core receptacle 22 comprises two retaining elements 23 and two clamp elements 25 which form a clamping gap 24. The core ends are inserted into the core receptacles 22 in that the core ends are initially inserted between and through the retaining elements 23 and then into the clamping gap 24. The retaining elements 23 thereby prevent the core ends from being able to exit the clamping gap 24 and then also the core receptacle 22 (cf. FIG. 2 and FIG. 4).

FIGS. 2 and 3 further show that when the union nut 4 is screwed onto the external thread 8 of the connection body 9, the splice part 6 is pressed into the connection body 9, wherein the insulation displacement terminations 10 arranged in the connection body 9 extend into the incisions 5 which are formed in the core-guiding part 12 and are open on the front end. In this manner, a reliable contacting of the outwardly shifted core ends which cross the incisions 5 is ensured via the insulation displacement terminations 10.

FIGS. 4 and 5 show an embodiment of a core-guiding part 12 in two different perspective views. The core-guiding part 12 comprises, in this embodiment, eight core receptacles 22, wherein each core receptacle 22 has two retaining elements 23 and two clamp elements 25 which form a clamping gap 24.

As is especially clearly shown in FIG. 5, the retaining elements 23 are arranged first and are followed by the clamp elements 25 with respect to the core insertion direction. The outer surfaces 26 of the clamp elements 25 thereby are just as far from the longitudinal axis of the core-guiding part 12 as the inner surfaces 27 of the retaining elements 23. Following the clamp elements 25 in the core insertion direction, a contact area 28 is arranged whose outer surfaces 29 are as far from the longitudinal axis of the core-guiding part 12 as the distance between the inner surfaces 30 of the clamp elements 25. As all surfaces in the present case are flat surfaces, the current distance refers to the distance between the respective plane normal and the longitudinal axis of the core-guiding part 12. FIG. 4 thereby shows the step-like arrangement of the retaining elements 23, the clamp elements 25, and the contact area 28.

FIG. 6 shows a section of the core-guiding part 12, namely a core receptacle 22 in an enlarged view. The retaining elements 23, the clamp elements 25, and the contact area 28 are offset with respect to one another, namely arranged in a step-like manner. The inner surfaces 27 (not shown in the depiction according to FIG. 6) of the retaining elements 23 are as far from the longitudinal axis of the core-guiding part 12 as the outer surfaces 26 of the clamp elements 25. The inner surfaces 27 of the retaining elements 23 thus lie in one plane with the outer surfaces 26 of the outer surface 26 of a clamp element 25, which outer surface always follows a retaining element 23 in the core insertion direction. The inner surfaces 30 of the clamp elements 25 also are as far from the longitudinal axis as the outer surfaces 29 of the contact area 28. The retaining elements 23 and the clamp elements 25 as well as the clamp elements 25 and the contact area 28 are arranged separated from one another, so that, in the core insertion direction, a gap is, in each case, formed between the retaining elements 23 and the clamp elements 25 as well as between the clamp elements 25 and the contact area 28. To facilitate core insertion, the retaining elements 23 have lead-in chamfers 31 inclined in the direction of the clamping gap 24.

Figure 7:
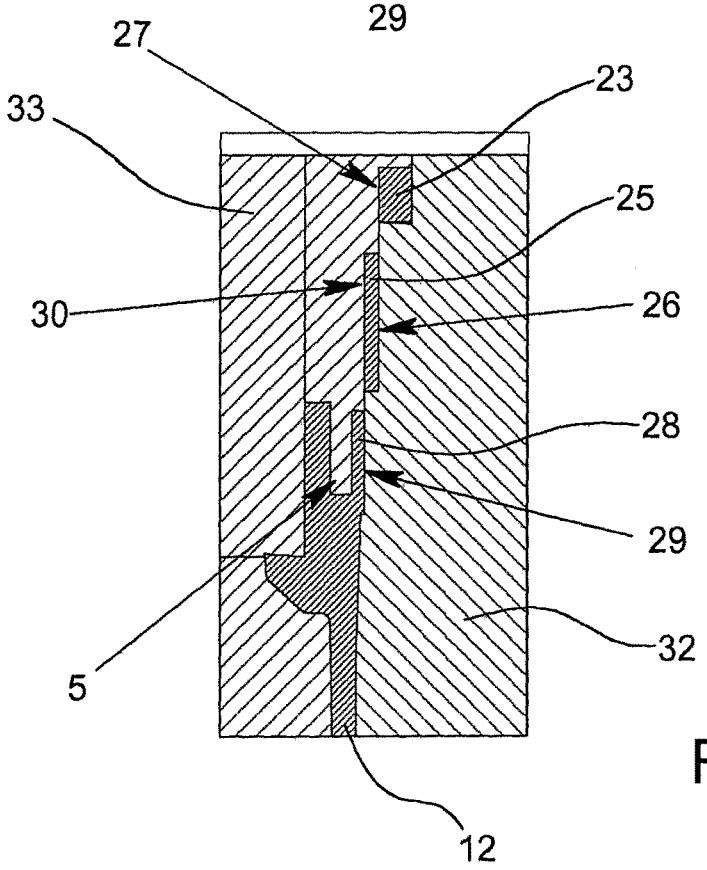
FIG. 7 is a sectional view of part of a core-guiding part.

FIG. 7 shows a section of the core-guiding part 12 during manufacture in an injection molding process, namely between a first mold part 32 and a second mold part 33. The depicted cut extends eccentrically through a core receptacle 22 and slices a retaining element 23, a clamp element 25, and the contact area 28 with—according to FIG. 7, left—an incision 5, arranged behind it, for an insulation displacement termination 10. It is clearly shown that the inner surface 27 of the retaining element 23 is the same distance from the longitudinal axis of the core-guiding part 12 as the outer surface 26 of the clamp element 25. Correspondingly, the inner surface 30 of the clamp element 25 has the same distance to the longitudinal axis of the core-guiding part 12 as the outer surface 29 of the contact area 28. Due to this step-like arrangement of the retaining elements 23, the clamp elements 25, and the contact area 28, the core-guiding part 12 may, in a simple manner, be removed from the first mold part 32 and the second mold part 33 in its longitudinal direction, namely in that the first mold part 32 according to FIG. 7 is moved downward and the second mold part 33 according to FIG. 7 is moved upward.

What is claimed is:

1. A cable connection component for electrically connecting a multi-core cable, comprising:

a union nut having an internal thread, a splicing part made of an insulating material and having a plurality of incisions shaped for separating cores of the cable when the union nut is screwed onto a connection body having an external thread corresponding to the internal thread of the union nut, wherein the splicing part has a cable-receiving part and a core-guiding part, the core-guiding part having at least two core receptacles, each core receptacle has at least two retaining elements and at least two clamp elements which together form a clamping gap, wherein, in a core insertion direction, first the retaining elements are arranged, and the clamp elements are arranged behind them, and wherein distances of outer surfaces and inner surfaces of the clamp elements and the retaining elements with respect to a longitudinal axis of the core-guiding part are such that the retaining elements and the clamp elements are arranged do not overlap each other in the core insertion direction.

2. The cable connection component according to claim 1, wherein the distance between the outer surfaces of the clamp elements and the longitudinal axis of the core-guiding part is less than or equal to the distance between the inner surfaces of the retaining elements and the longitudinal axis.

3. The cable connection component according to claim 2, wherein each of the core receptacles has a contact area following the clamp elements in the core insertion direction and wherein the distance between the outer surfaces of the contact area and the longitudinal axis is less than or equal to the distance between the inner surfaces of the clamp elements and the longitudinal axis.

4. The cable connection component according to claim 1, wherein at least one of the retaining elements and the clamp elements and the clamp elements and the contact area are physically separated from one another in the longitudinal direction of the core-guiding part.

5. The cable connection component according to claim 1, wherein the inner surfaces of two clamp elements and of two adjacent core receptacles lie in a common plane and wherein the common plane is arranged parallel to the longitudinal axis of the core-guiding part.

6. The cable connection component according to claim 5, wherein the outer surfaces of the two clamp elements and the inner surfaces of the two retaining elements of two neighboring core receptacles are arranged in a common plane.

7. The cable connection component according to claim 1, wherein at least one of the inner surfaces of the retaining elements are arranged on a common first radius and the inner surfaces of the clamp elements are arranged on a common second radius about the longitudinal axis of the core-guiding part.

8. The cable connection component according to claim 7, wherein the inner surfaces of the retaining elements and the outer surfaces of the clamp elements are arranged on the common first radius.

9. The cable connection component according to claim 1, wherein the core receptacles are arranged asymmetrically on the circumference of the core-guiding part.

10. The cable connection component according to claim 1, wherein the cable-receiving part has several latching arms on a side facing the core-guiding part and wherein the core-guiding part has, on a side facing the cable-receiving part, several inwardly projecting latching catches or catch recesses corresponding to the latching arms, so that the core-guiding part is able to latch with the cable-receiving part.

* * * * *